United States Patent [19]

McMahan, Jr. et al.

[11] Patent Number: 4,880,025

[45] Date of Patent: Nov. 14, 1989

[54] BOP CONTROL SYSTEM AND METHODS FOR USING SAME

[75] Inventors: James M. McMahan, Jr.; Roland G. Harper, Jr., both of Houston, Tex.

[73] Assignee: Baroid Technology, Inc., Tex.

[21] Appl. No.: 346,245

[22] Filed: May 1, 1989

Related U.S. Application Data

[63] Continuation of Ser. No. 110,004, Oct. 19, 1987, abandoned.

[51] Int. Cl.[4] ..... H01B 1/00

[52] U.S. Cl. ..... 137/1; 137/560; 174/9 F

[58] Field of Search ..... 137/560, 807, 825, 909, 137/1; 251/1.1; 174/9 F, 47

[56] References Cited

U.S. PATENT DOCUMENTS

| | | | |
|---|---|---|---|
| 3,601,519 | 8/1971 | Wanner et al. | 174/9 F |
| 3,866,678 | 2/1975 | Jeter | 174/9 F X |
| 3,878,312 | 4/1975 | Bergh et al. | 174/9 F |
| 4,013,538 | 3/1977 | Schneider et al. | 174/9 F |
| 4,095,421 | 6/1978 | Silcox | 251/1.1 X |

OTHER PUBLICATIONS

Deepwater Hydraulic BOP Control Systems, by A. N. Vujasinovic, et al; presented at the SPE European Petroleum Conference held in London Oct. 20-22, 1986, Copyright 1986.

*Primary Examiner*—John Rivell

*Attorney, Agent, or Firm*—Browning, Bushman, Zamecki & Anderson

[57] ABSTRACT

A BOP subsea control system utilizes hydraulic control of non-critical functions, and electro-hydraulic control of selected critical functions, such as the closing mode of one or more shear ram BOPs, one or more pipe ram BOPs and one or more annular type BOPs. In an alternative embodiment, the use of a conductive fluid in a hydraulic hose enables electric signals and hydraulic signals to be transmitted in the same hose.

4 Claims, 6 Drawing Sheets

BOP CONTROL SYSTEM AND METHODS FOR USING SAME

This is a continuation of co-pending U.S. Application Ser. No. 110,004 filed on Oct. 19, 1987 now abandoned.

BACKGROUND OF THE INVENTION

1. Field of the Invention

The present invention relates to methods and to a system for controlling a subsea blowout preventer (BOP) system, in general, and specifically relates to such BOP control systems and methods having both electrical and hydraulic lines leading from the surface of the sea to the BOP system on the ocean floor.

2. Description of the Prior Art

Safety considerations in offshore drilling activities dictate that a subsea BOP must be able to rapidly close the well bore regardless of water depth at the drilling location. Conventional hydraulic BOP control systems experience unacceptable delays in operating subsea BOP functions in deep water applications because (1) the time required to send a hydraulic activation signal through an umbilical hose from the surface control station to the subsea pilot control valve becomes excessively long in deep water, and (2) delivery of sufficient quantities of pressurized operating fluid to the BOP function from the surface requires a substantial amount of time. These two elements of a complete BOP sequence time are usually referred to as signal time and fill-up time, respectively.

Methods used previously to reduce signal time have included increased hose sizing and higher operating pressure, while fill-up time has been minimized through the use of subsea fluid storage accumulators to effectively reduce the distance some of the fluid must flow before reaching the BOP. The adequacy of these methods has been challenged by the desire to drill in deep waters approaching 4,000 feet where conventional systems have drawbacks. Large diameter hose bundles in long lengths require substantial deck space for storage and pose running/retrieval handling difficulties. Also, the usable subsea accumulator volume diminishes with increasing water depth because of external hydrostatic pressure effects, thus forcing more accumulator bottles to be installed subsea as the water depth increases.

Although multiplex electric BOP control systems are known in the art, such systems are very expensive and complex. Prior to the systems described hereinafter in accordance with the present invention, the operators were faced with the prospect that, in order to drill in deeper water, their existing hydraulic control systems would need to be replaced with the more complex, more expensive multiplex electric BOP control systems.

Previous attempts to retrofit electrical controls to existing hydraulic control systems have involved substantial and complex equipment modifications with significant installation/check-out cost onboard the drilling rig.

It is therefore the primary object of the present invention to provide a new and improved BOP control system.

It is also an object of the present invention to provide a new and improved BOP control system which uses existing hydraulic lines to control non-critical functions and electrical lines to control critical functions.

It is yet another object of the prevent invention to provide a new and improved system for providing electrical signals through hydraulic lines.

It is still another object of the present invention to provide new and improved methods for controlling subsea BOP systems.

SUMMARY OF THE INVENTION

The primary objects of the present invention are accomplished, generally, by a system which extends the depth capability of an hydraulic BOP control system by means of electric signal conversion equipment fitted to selected critical functions of the subsea BOP system.

Another object of the present invention is accomplished by the provision of methods which determine selected critical functions to be controlled and which convert these functions to be electrically controlled, while leaving other functions to be controlled hydraulically.

Yet another object of the present invention is accomplished by the provision of a system which uses a conductive fluid as hydraulic fluid, thus allowing hydraulic signals and electrical signals to be transmitted through the same fluid.

BRIEF DESCRIPTION OF THE DRAWINGS

These and other objects, features and advantages of the present invention will become apparent from the detailed specification read in conjunction with the drawings in which.

DESCRIPTION OF THE PREFERRED EMBODIMENT

Figure 1:
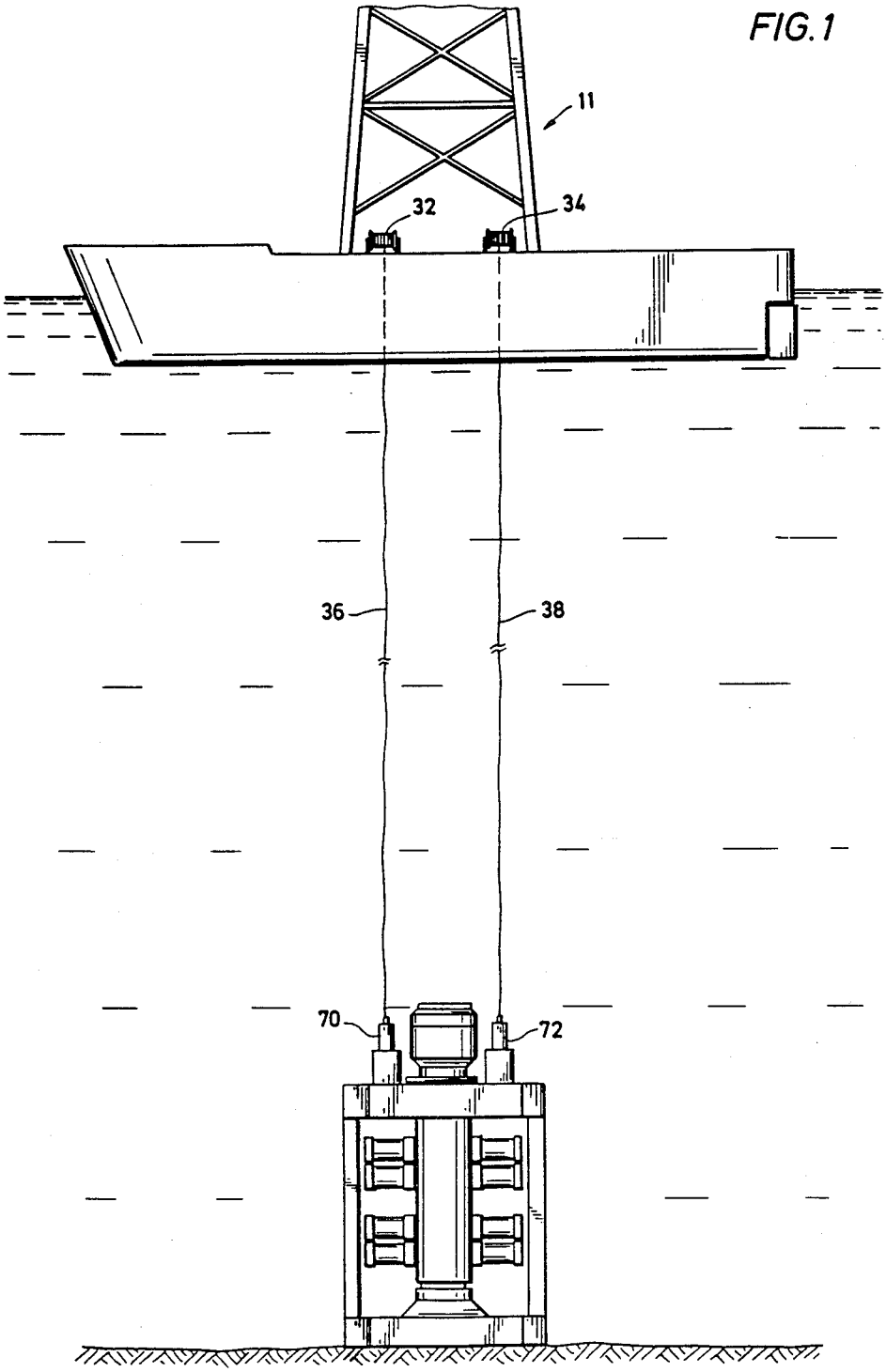
FIG. 1 is a schematic view, in elevation, of a drill ship in location above a subsea BOP system.

As will be readily appreciated, the present invention contemplates the conversion of an existing hydraulic control system to one in which selected "critical" functions are controlled by electrical lines, while leaving the non-critical functions to be controlled by the existing hydraulic lines. Defined as critical are those BOP functions considered essential in containing a kick or blowout from the well during drilling operations. Functions satisfying this criteria will vary with the particular BOP equipment onboard and, typically, may include the shear ram BOP, multiple sets of pipe ram BOPs, and one or two annular type BOPs. Critical functions may also include at least one pair of choke and kill valves and/or the marine riser lower disconnection device depending upon operator preference. The use of electrical signaling techniques for critical functions can eliminate hydraulic signal delay altogether, except when the existing hydraulic system is used as backup control, with the result that the operation time of critical BOP functions can be reduced to actual fill-up time which is presently well within prescribed time limits regardless of water depth.

As used herein, "E/H" refers to electro-hydraulic. The E/H conversion concept involves the addition of electrical/electronic control components to existing piloted hydraulic control systems in such a manner as to enable critical BOP functions to be actuated electrically in lieu of the existing hydraulic pressure activation techniques. Such conversion circuitry can, because of economic and logistical necessity, maximize the continued use of much existing hydraulic control hardware often including surface control panels, hydraulic umbilical, subsea hydraulic control pods, and running/retrieval handling equipment. The additional conversion components include a surface electrical power supply with fault protection and operator safety appliances, redundant electric cables and deployment reels, and redundant subsea electric solenoid valve packages designed for mounting on or near existing hydraulic control pods.

The primary difference between the E/H conversion concept and conventional E/H BOP control systems, introduced over a decade ago, is the limitation of electric capability to "critical" BOP functions only and system packaging specifically facilitating add-on conversion of hydraulic systems. The limitation to critical functions is of prime importance in influencing the overall cost of E/H conversion. Each electrically controlled function is operated by its own dedicated pair of wires in the subsea electric cables, and the aggregate total of all electrically controlled functions will determine the size and complexity of both the surface power supply equipment and the size of the subsea electric solenoid valve packages. The capacity and, hence, the physical size of the subsea electric cables is also influenced by the number of electrically controlled functions in an E/H conversion system.

Installation of an E/H conversion system also results in an economical backup control capability for the critical BOP functions. The electric controls serve as the primary system while the existing piloted hydraulic controls become the secondary method of operation by means of subsea shuttle valves.

Figure 2A:
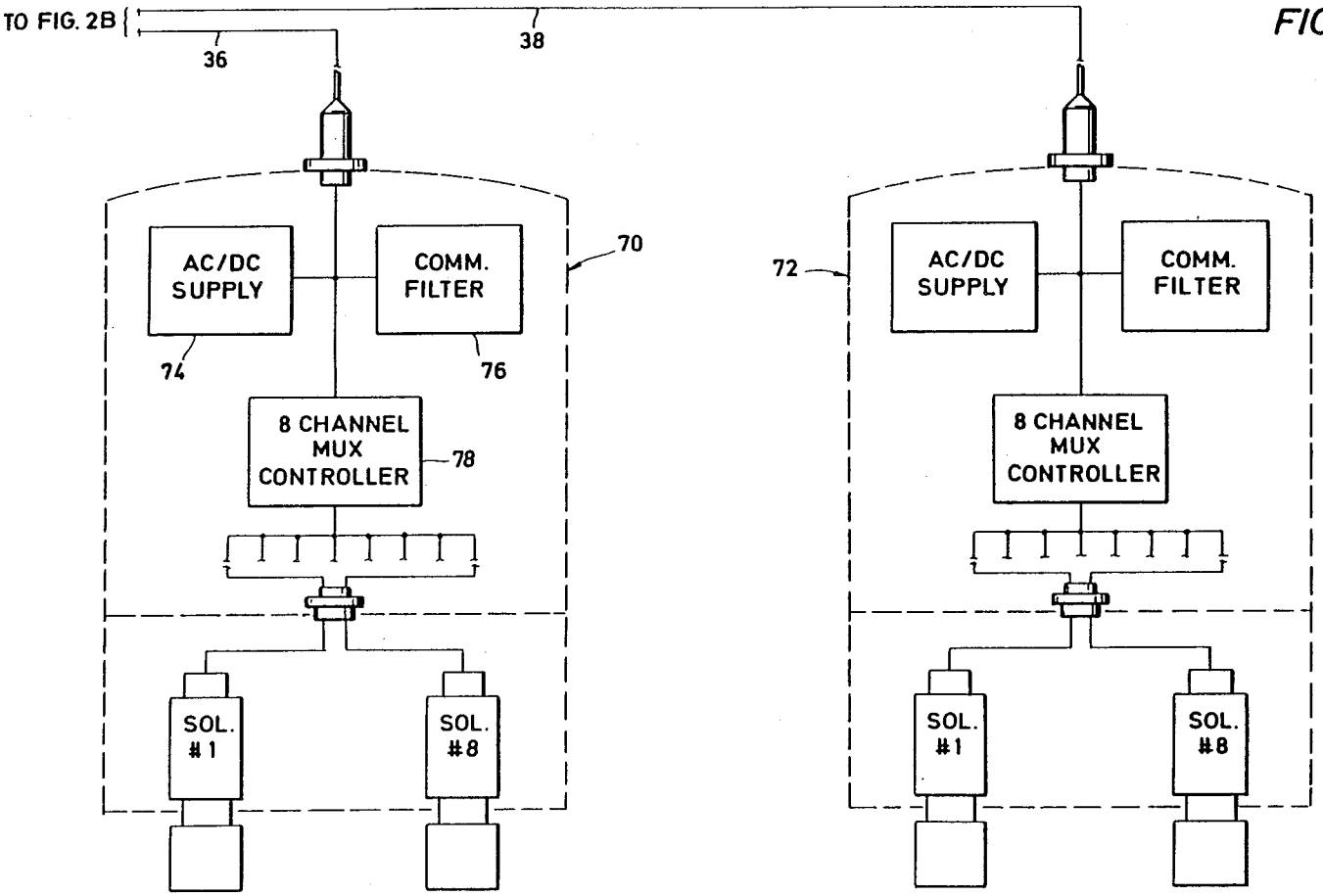
FIG. 2A is a schematic view, partly in block diagram, of a pair of electro-hydraulic pods used in accordance with the present invention.
Figure 3:
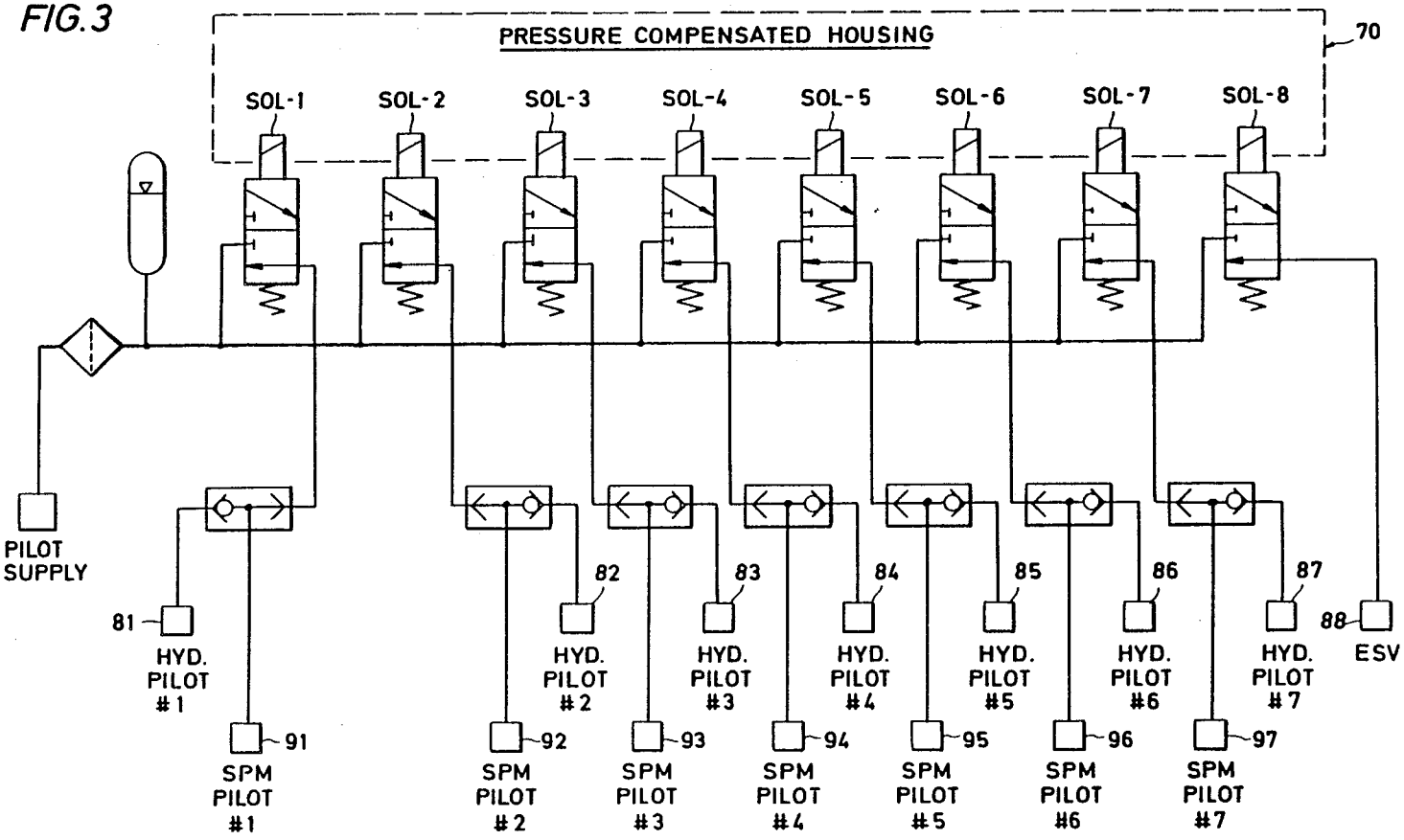
FIG. 3 is a schematic view of the subsea interface between the electric and hydraulic circuits used in accordance with the invention.

Referring now to FIGS. 1 and 2A, there is illustrated a floating drill ship 10 having a conventional drilling rig 11 in the water 14 for drilling a conventional well into the sea floor 16.. Located on the drill ship 10 are a pair of redundant reels 32 and 34, connected, respectively, through the umbilicals 36 and 38, to a pair of pods 70 and 72. Since the pods are identical, only pod 70 will be described. The pod 70 includes an ac/dc supply 74 and a communications filter 76, as well as an eight channel multiplex controller 78. The outputs of the multiplex controller 78 are hardwired to the eight solenoid units SOL1–SOL8. The system provides electric pilot control for seven subsea functions plus one electric pilot control function to operate an ESV (energy saving valve) valve or a pair of ESV valve assemblies in parallel when dual annular preventers are present. The seven control functions may be assigned according to the configuration of the BOP stack. For example, the functions may be assigned as the "Close" function of two annulars, four rams, and one spare plus the pre-assigned ESV function. The ESV 88, shown in FIG. 3, is described in U.S. Pat. No. 4,509,405, assigned to NL Industries, Inc., the assignee of the present application. The system has been specifically designed to operate with a variety of electric cable types in order to provide flexibility in retrofit applications. The particular cable type used is a low cost, armored coaxial cable having widespread application in subsea TV and geophysical work. In addition to low cost, this cable features light weight (approximately 700 lbs/1000 ft), small bend radius (18 inches), and a small diameter (approx. 0.7 inch). These features enable small, low cost storage/deployment reels to be used (48 inch flange by 36 inch drum length @4,200 ft. of cable).

These reels do not include electrical slip rings and none are required for the system. Large multiplex control systems need slip rings to maintain control of subsea functions during BOP stack running/retrieving operations, but the present system allows continued operation of the conventional hydraulic controls which can be used during the running/retrieving operation as well as used for backup control while drilling.

The subsea control equipment consists of a pair of electric subsea control pods 70 and 72 which can be mounted on 42-line, 60-line, or other conventional hydraulic control pods. All connections between the hydraulic pod and the pods 70 and 72 are hydraulic.

The control pods 70 and 72 include a one-atmosphere canister containing the multiplex electronics. The electronics, itself, is configured from off-the-shelf products having widespread use in addition to satisfying the performance criteria for this type of application. Operating temperature of the complete subsea pod is minus 20° C. to 70° C. without additional low temperature protection.

Figure 2B:
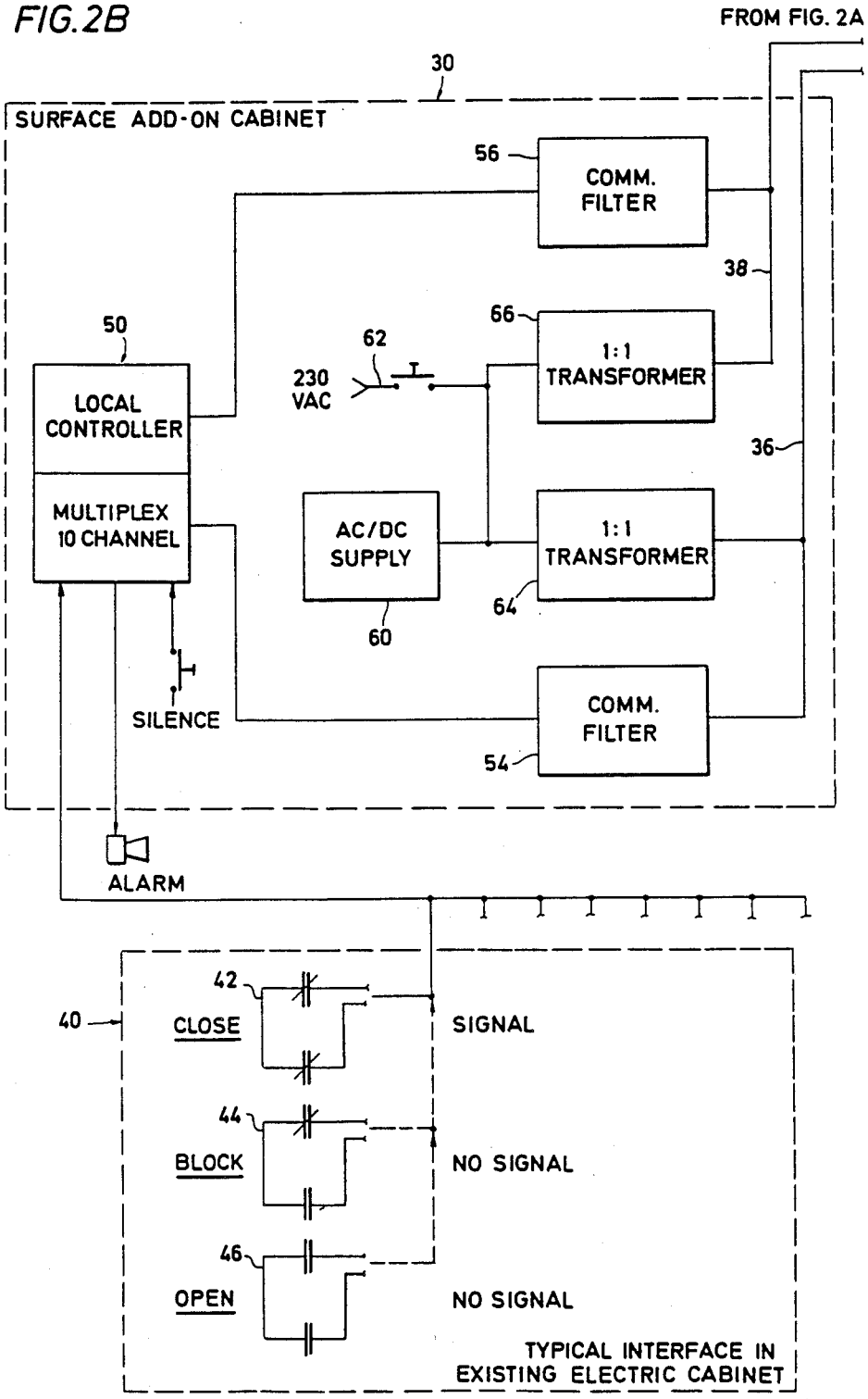
FIG. 2B is a block diagram of electronic circuitry used in accordance with the present invention.

Referring now to FIG. 2B, there is illustrated the surface equipment 30 which consists of a single NEMA 4x enclosure (stainless steel) containing the necessary electronics used to operate redundant subsea electronic control units. The additional surface equipment consists of redundant umbilical storage/deployment reels 32 and 34. Two separate electric umbilical 36 and 38 are used to interconnect the two subsea control units with the single surface electronics cabinet. Control signals which operate the system are derived from auxiliary relays within the Toolpusher's Panel (not illustrated) of an existing hydraulic control system.

Conventional hydraulic BOP control systems for drilling vessels employ electric control panels which operate valves on the surface hydraulic manifold for function controls. Function relays contained within one of the existing electric control panels, illustrated generally at 40, usually within the Toolpusher's Panel, perform the "Open-Block-Close" logic for each function, and the relays 42, 44 and 48 are equipped with auxiliary contacts which are unused. These auxiliary contacts on the existing relays form the control signal interface in accordance with the present invention. For each of the seven critical functions, a normally-open auxiliary contact of the "Close" relay would be placed in series with a normally-closed auxiliary contact of the "Open" relay. The resulting series circuit would then be hardwired as one of seven identical circuits to the surface cabinet. The two relay contacts in series result in a closed circuit for the "Close" command and an open circuit for both the "Block" and "Open" commands. Therefore, the surface cabinet will respond only to the "Close" command by operating the appropriate subsea solenoid valve. When "Block" or "Open" is selected, the signal disappears and the subsea solenoid deactivates. Excitation voltage for the relay signal circuit interface can be from an existing system power supply or can be furnished by another source.

The surface electronics also controls operation of the subsea ESV circuits: however, no external surface interface is necessary as this function is entirely automatic and preprogrammed within the surface electronics cabinet.

The surface equipment 30 includes a conventional local controller and ten channel multiplexer 50. Connected to outputs of the local controller, multiplexer 50 are a pair of communications filters 54 and 56, the outputs of which are connected, respectively, to the umbilical 36 and 38, through the reels 32 and 34. An ac/dc supply 60 and 230 vac supply 62 are coupled through a pair of 1:1 transformers 64 and 66, whose outputs are connected, respectively, to the outputs of filters 54 and 65.

The transformers 64 and 66 may also be relocated away from the cabinet in a safe area aboard the rig, and the electronics enclosure upgraded to NEMA 7 for service in hazardous environments if required. Primary power would be a single 240 VAC, 50/60 HZ tie to the ship's power system capable of supplying 1500 VA maximum with a power factor of about 0.95 or better.

Operating temperature of the surface equipment is specified as 0°–70° C.; however, a 100 watt, thermostatically controlled heater installed within the enclosure would extend the lower temperature limit to −20° C. while 200 watts of heating would yield a −40° C. low temperature operating limit. It is recommended that the surface equipment cabinet be installed in the Toolpusher's office to eliminate any auxiliary heating requirements.

Referring now to FIG. 3, there is illustrated, schematically, the pod 70, with its eight solenoids, SOL-1–SOL-8, seven of which, in turn, are connected to seven hydraulic pilot valves 81–87. The solenoid SOL-8 is connected to the ESV valve 88. Also connected to the hydraulic valves are seven SPM pilot valves 91–97, for example, such as are available from the NL Shaffer Division of NL Industries, Inc., Houston, Tex., as Model No. SPM Control Valve, Part No. 10-05025.

The schematic of FIG. 3 illustrates the simple interconnection to a hydraulic control pod. Each function output, except the dedicated ESV function, is fitted with a shuttle valve which enables the conventional hydraulic hose pilots from the surface to be used as backup controls at all times, and no switchover controls are necessary to enable the hydraulic backup since the shuttle action is automatic in relation to applied pressure. The backup shuttle valve is illustrated and described in greater detail in a paper presented at the SPE European Petroleum Conference held in London, England on Oct. 20–22, 1986, under the title "Deepwater Hydraulic BOP Control Systems," presented by A. N. Vujasinovic and J. M. McMahan, the entirety of such paper being incorporated herein by reference.

Referring now to the overall system, it should be appreciated that the subsea pod contains a pre-programmed digital controller which interprets commands from the surface and activates the appropriate functions. The controller program is stored entirely in Read-Only Memory and is standard for any system contemplated herein. The program is written in assembly language and provides the following capability:

Receive/transmit to surface electronics;
Interpret serial command message and energize specified function;
Perform serial received message error check;
Calculate message check sum for transmission to surface electronics;
Perform power-up self diagnostics;
Transmit diagnostic results on request to surface electronics.

The surface equipment 30 contains an IBM compatible computer which would employ a standard software program, and the program would be stored in a non-volatile memory chip. The computer employs a Z80B-8 bit microprocessor operating at 4.9 MHZ and is equipped with 32K Bytes of EPROM memory and 32K Bytes of CMOS RAM with 10 year battery backup. The software will be written in MICROSOFT Basic and will make use of internal software utilities including IBM command compatible Basic Interpreter, assembly language communications driver, and arithmetic utilities. A hardware deadman timer with software reset provides alarm annunciation in the event of system malfunction, and a real-time clock with 10 year battery backup and power fail/auto restart detection software assure automatic startup on application of system power.

The deadman timer alarm system will be used with programming logic to indicate malfunctions of both the surface and/or subsea equipment. Three alarms could be provided, if preferable, to uniquely annunciate malfunctions in the three major equipment packages:

surface electronics
control pod 70
control pod 72

In the use of the system described herein, rather than converting a conventional hydraulic system to an electrohydraulic system for all functions, it should be appreciated that we have discovered that only the critical functions need be converted, thus saving enormous time and money. These critical functions are defined as essential in containing a "kick" or "blowout" during drilling operations. For example, the time of closing of a BOP is critical: the time of opening a BOP is not necessarily critical.

The underlying cause of excessive signal time is the relatively large volumetric expansion characteristic of common hydraulic hose, and although improved low expansion hose is available, all presently available hydraulic hose exhibits poor signal response time performance from the presence of high glycol concentrations (40–50%) in the hydraulic fluid used during cold weather operations to prevent fluid freezing. The use of the electric signaling technique for critical functions can eliminate hydraulic signal time altogether with the result that the operation time of critical BOP functions can be reduced to actual fill-up time which is presently well within prescribed time limits regardless of water depth and temperature.

Again, although the functions defined as "critical" may vary with the particular BOP equipment onboard, the critical functions will typically include the closing of the shear ram BOP(s), multiple sets of pipe ram BOPs, and one or two annular type BOPs. The critical functions may also include at least one pair of choke and kill valves and/or the marine riser lower disconnection device, if desired.

Although the invention contemplates the conversion of selected hydraulic functions to electro-hydraulic control, the invention also contemplates a system which, when new, utilizes hydraulic control of non-critical functions and which utilizes electro-hydraulic control of selected critical functions.

Figure 4:
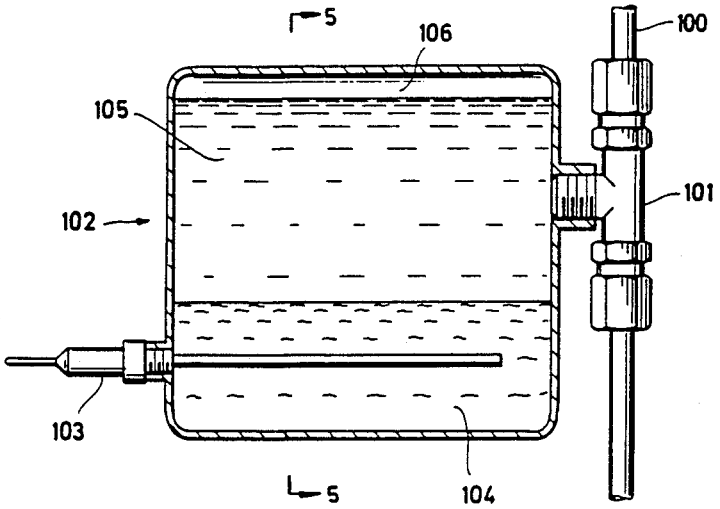
FIG. 4 is an elevational view, partly in cross section, of an electrical apparatus connected to a hydraulic hose in accordance with the present invention.
Figure 5:
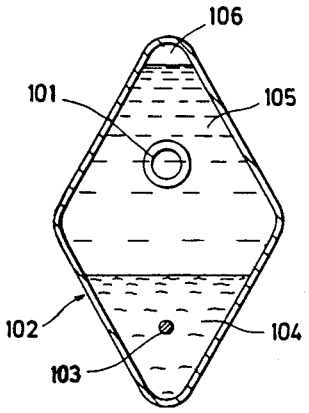
FIG. 5 is an end view of the apparatus according to FIG. 4 taken along the section lines 5—5.

Referring now to FIGS. 4 and 5, there is illustrated an alternative embodiment of the present invention. Whereas the methods and systems described above with respect to FIGS. 1–3 contemplate that two subsea electric umbilical cables and reels be used in conjunction with the existing hydraulic control system, the embodiment of FIG. 4 contemplates that the existing two hydraulic umbilical be used to convey subsea electrical power without using the two separate subsea electric umbilical.

Thus, the invention contemplates the interfacing of electrical power and signals into each end of two or more hydraulic pilot lines or umbilical used for control of a subsea BOP.

In FIG. 4, there is illustrated a hydraulic pilot line 100 connected through a tee connection 101 to a box 102. The hydraulic tee 101 is prefereably non-conductive, for example, of stainless steel. An electrode 102 extends through the side of the box 102 and can be electrically insulated, if desired, from the side of the box through which it extends, even though the box itself is preferably non-conductive, for example, stainless steel. FIG. 5 illustrates an end view of the box 102 taken along the sectional line 5—5 of FIG. 4.

Inside the box 102 is a lower level of mercury 104, above which is an electrolyte fluid 105, and above which is air space 106. The hydraulic line 100 is filled with the electrolyte fluid 105. Such hydraulic lines are generally non-conductive, being variously comprised of neoprene, rubber or plastic. At the remote end of hydraulic line 106, for example, on the surface of a drill ship, is a second box which can be identical to the box 102, and having an electrode, a level of mercury, a level of electrolyte and an air space like those illustrated with respect to the box 102.

The flow of electric current through a fluid medium falls into the branch of the physical sciences known as electrochemistry, and is generally referred to as electrolytic conduction, for example, in the *Handbook of Physics*, Condon and Odishaw, McGraw-Hill, 1958. Electric current flow through such a fluid is predominantly by means of an ion transport mechanism, but current flow by means of charged particles (e.g., metal movement in solution) may also be present. The charged particle mechanism generally falls into the category of metal plating processes of electrochemistry and is considered to be a disadvantage, as contemplated by the present invention, one which is to be minimized because of the electrochemical oxidation-reduction that would otherwise take place. This reaction is minimized in three ways: the interface created by the box 102 employs mercury as an electrode in fluid contact; alternating current polarity is preferably used; and the fluid 105 preferably consists of a sub-atomic structure favoring ionic transport.

In its preferred form, the fluid 105 is a common, water-based hydraulic fluid, being a water and ethylene glycol mixture. Such a mixture normally exhibits a high dielectric constant and would therefore generally be a non-conductor. By transforming the hydraulic fluid into a weak electrolyte containing predominantly ions and neutral molecules, the fluid 105 can thus be used as a conductive medium. An analogous fluid mixture is well known and used in the manufacture of modern electrolytic capacitors.

In using the apparatus illustrated in FIG. 4, it should be appreciated that this embodiment is illustrated and described in a rather simple form. For example, if desired, those skilled in the art may desire to modify the box 102 to allow for minute outgassing from the electrode process. Basically, the box 102 consists of an insulated vessel to which the hydraulic pilot hose is attached, and into which a suitable electrode contact is placed. Suitable electrode contacts may be carbon, copper, gold or silver alloys, platinized titanium, or a conductive elastomer, just to name a few. Mercury 104 is placed in the insulated vessel such that only the mercury may contact the electrode 103 and simultaneously contact the weak electrolyte fluid. The electrolyte fluid 105 fills the entire length and volume of the pilot hose, which can be thousands of feet long between the drill ship and the subsea BOP.

Through the use of two boxes, such as box 102, one on each end of hose 100, and through the use of two such hydraulic hoses, there can be formed a complete electrical circuit. Such a circuit is illustrated schematically in FIG. 7. A BOP 110 is located on the sea floor 111. An electrically operated pilot valve 112 is used to close the BOP 110. A hydraulic operator 113, for example, a pilot valve, can be used as desired, for example, to open the BOP 110. Two hydraulic umbilicals containing hydraulic pilot lines 114 and 115 extend from the drill ship 116 to the subsea apparatus 117. Boxes 118, 119, 120 and 121, each identical to box 102 of FIG. 3, are located on the respective ends of the hydraulic lines 114 and 115. The hydraulic lines can be quite lengthy, for example, 4,000 feet or more.

A voltage source 130, preferably ac, is connected through a switch 131 to the boxes 120 and 121 on the drill ship 116. A hydraulic pump 133 is connected through the tee 134 to the hydraulic line 115. Within the subsea apparatus 117, the hydraulic operator 113 is connected to the hydraulic line 115 through the tee 135. The hydraulic lines 114 and 115 are completely filled with a weak electrolyte hydraulic fluid.

Figure 7:
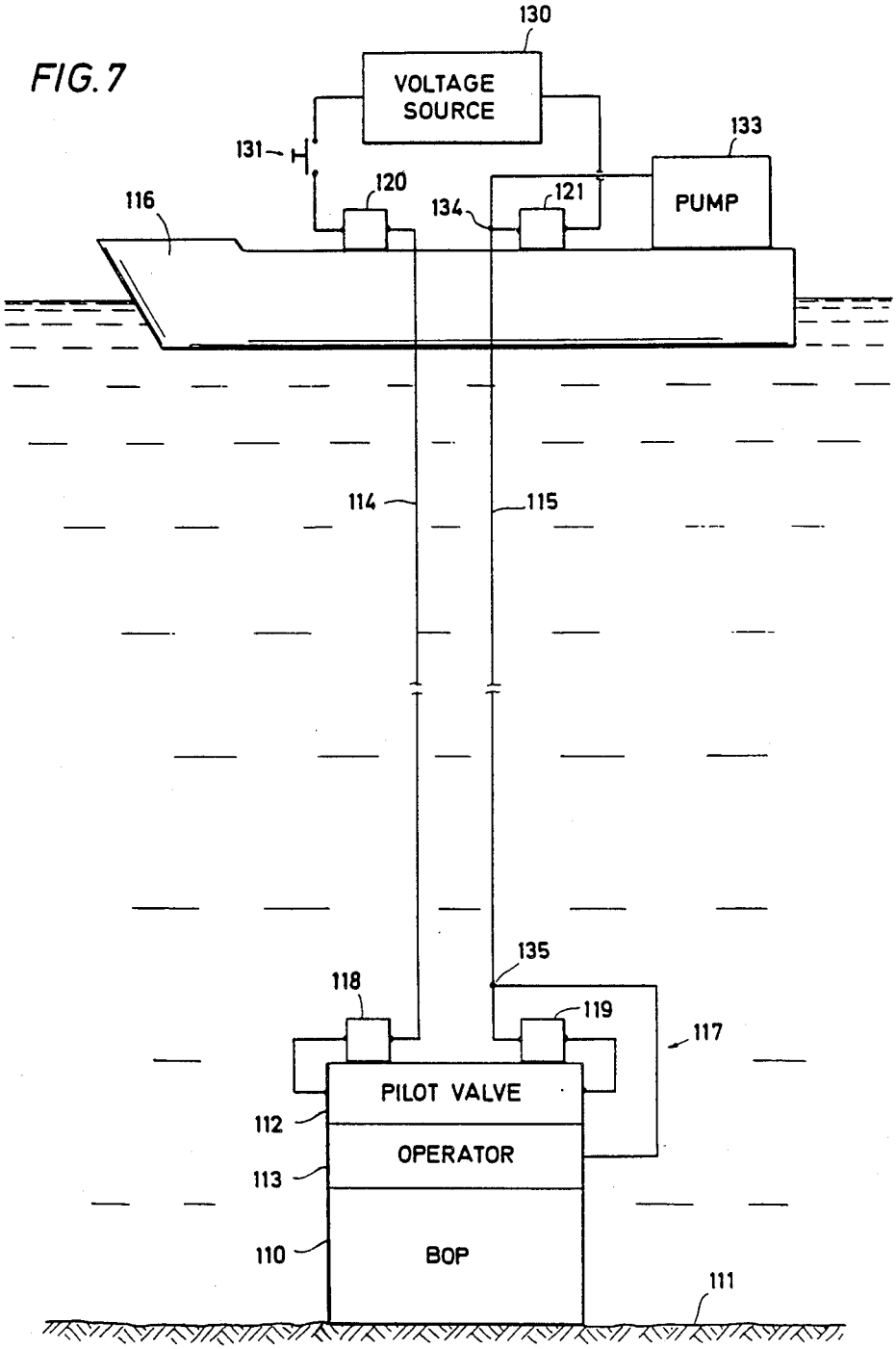
FIG. 7 is a schematic view, in elevation, of the apparatus according to either FIG. 4 or FIG. 6 in actual operation.

In the operation of the system illustrated in FIG. 7, the hydraulic pump can be used to activate the hydraulic operator 113, thus opening the BOP 110. When it is desired to close the BOP rapidly, as in the case of a kick or blowout of the well, the closing of switch 131 applies an electrical signal through the conductive hydraulic lines 114 and 115 to the pilot valve 112 to thus close the BOP 110.

Figure 6:
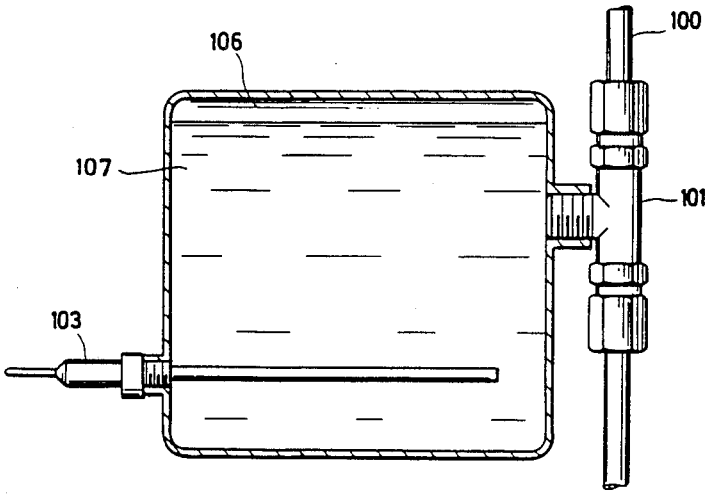
FIG. 6 is an apparatus according to an alternative embodiment of the invention.

Thus, the invention, as illustrated and described with respect to FIGS. 4 or 6 contemplates the use of a hydraulic line filled with conductive fluid to deliver an electrical signal, and also the use of a hydraulic line filled with conductive fluid to deliver both hydraulic and electrical signals through the same hydraulic line.

The invention can take other forms. For example, salt water can be used as the conductive fluid 107, and, if desired, the mercury can be eliminated, having the conductive fluid in direct contact with the electrode, 103 for example, as is illustrated in FIG. 6. The conductive fluid could also be common battery electrolyte, or could be standard electrolyte fluids used in metal electroplating processes if metal plating creates no appreciable problem.

What is claimed is:

1. A control system for controlling a subsea BOP system, wherein said BOP system includes a plurality of controllable functions, comprising:

(a) electro-hydraulic control means for controlling selected of said plurality of functions; and (b) hydraulic control means for controlling the remainder of said plurality of functions.

2. The control system according to claim 1 wherein said BOP system comprises a plurality of BOPs and each of said BOPs has an opening mode and a closing mode, and said selected functions comprise at least the closing modes of each of said BOPs.

3. A method for converting a hydraulically controlled BOP subsea system having a plurality of controllable functions, comprising:

(a) determining which of said functions is critical in controlling a blowout: and (b) converted the hydraulic control of said critical functions to that of being electro-hydraulically controlled.

4. The method according to claim 3 wherein said BOP subsea system comprises a plurality of BOPs, each having a closing mode and an opening mode, and said functions determined to be critical include at least the closing modes of each of said BOPs.

* * * * *

UNITED STATES PATENT AND TRADEMARK OFFICE

CERTIFICATE OF CORRECTION

PATENT NO. : 4,880,025

DATED : November 14, 1989

INVENTOR(S) : James M. McMahan; Roland G. Harper, Jr.

It is certified that error appears in the above-identified patent and that said Letters Patent is hereby corrected as shown below:

In Column 10, line 6, delete "converted" and insert therefor --converting--.

Signed and Sealed this

Thirtieth Day of October, 1990

*Attest:*

HARRY F. MANBECK, JR.

*Attesting Officer*

*Commissioner of Patents and Trademarks*